US011614697B1

(12) United States Patent
Pettingill et al.

(10) Patent No.: US 11,614,697 B1
(45) Date of Patent: Mar. 28, 2023

(54) MODULES WITH INNER MODULE SPACES FOR PRINT MATERIALS

(71) Applicant: HEWLETT-PACKARD DEVELOPMENT COMPANY, L.P., Spring, TX (US)

(72) Inventors: Justin D. Pettingill, Boise, ID (US); Jeffrey Harold Luke, Boise, ID (US); Gabriel Scott McDaniel, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/452,601

(22) Filed: Oct. 28, 2021

(51) Int. Cl.
*G03G 15/08* (2006.01)
*G03G 21/16* (2006.01)

(52) U.S. Cl.
CPC ..... *G03G 15/0865* (2013.01); *G03G 21/1676* (2013.01)

(58) Field of Classification Search
CPC ..... G03G 15/0865; G03G 21/1676
See application file for complete search history.

(56) References Cited

U.S. PATENT DOCUMENTS

| | | | | |
|---|---|---|---|---|
| 5,594,535 | A | 1/1997 | Beaufort et al. | |
| 10,705,450 | B2 * | 7/2020 | Koga | G03G 15/0812 |
| 2007/0274737 | A1 * | 11/2007 | Serizawa | G03G 15/0865 399/106 |
| 2009/0119965 | A1 * | 5/2009 | Broehl | A47G 1/06 40/721 |
| 2015/0139669 | A1 * | 5/2015 | Yoshizumi | G03G 15/0887 399/53 |

FOREIGN PATENT DOCUMENTS

KR 20060125018 A 12/2006

* cited by examiner

*Primary Examiner* — Sophia S Chen
(74) *Attorney, Agent, or Firm* — Foley & Lardner LLP

(57) ABSTRACT

In some examples, a print material apparatus includes a housing having an opening and an inner housing space, and a module removably attached to the housing to cover the opening, the module providing an inner module space that together with the inner housing space define a volume containing a print material of the print material apparatus. The housing is attachable to different modules that provide respective inner module spaces of different sizes for defining different print material containment capacities of the print material apparatus.

20 Claims, 8 Drawing Sheets

MODULES WITH INNER MODULE SPACES FOR PRINT MATERIALS

BACKGROUND

A printing device can deliver a print material to a print medium to form an image on the print medium. In some examples, a printing device can be an electrophotographic printing device that supplies a toner (which is a type of print material) to an electrostatic latent image formed on a photoreceptor to form a visible toner image on the photoreceptor. The electrophotographic printing device transfers the toner image to a print medium, and then fixes the transferred toner image to the print medium, to form an image on the print medium.

BRIEF DESCRIPTION OF THE DRAWINGS

Some implementations of the present disclosure are described with respect to the following figures.

Figure 1:
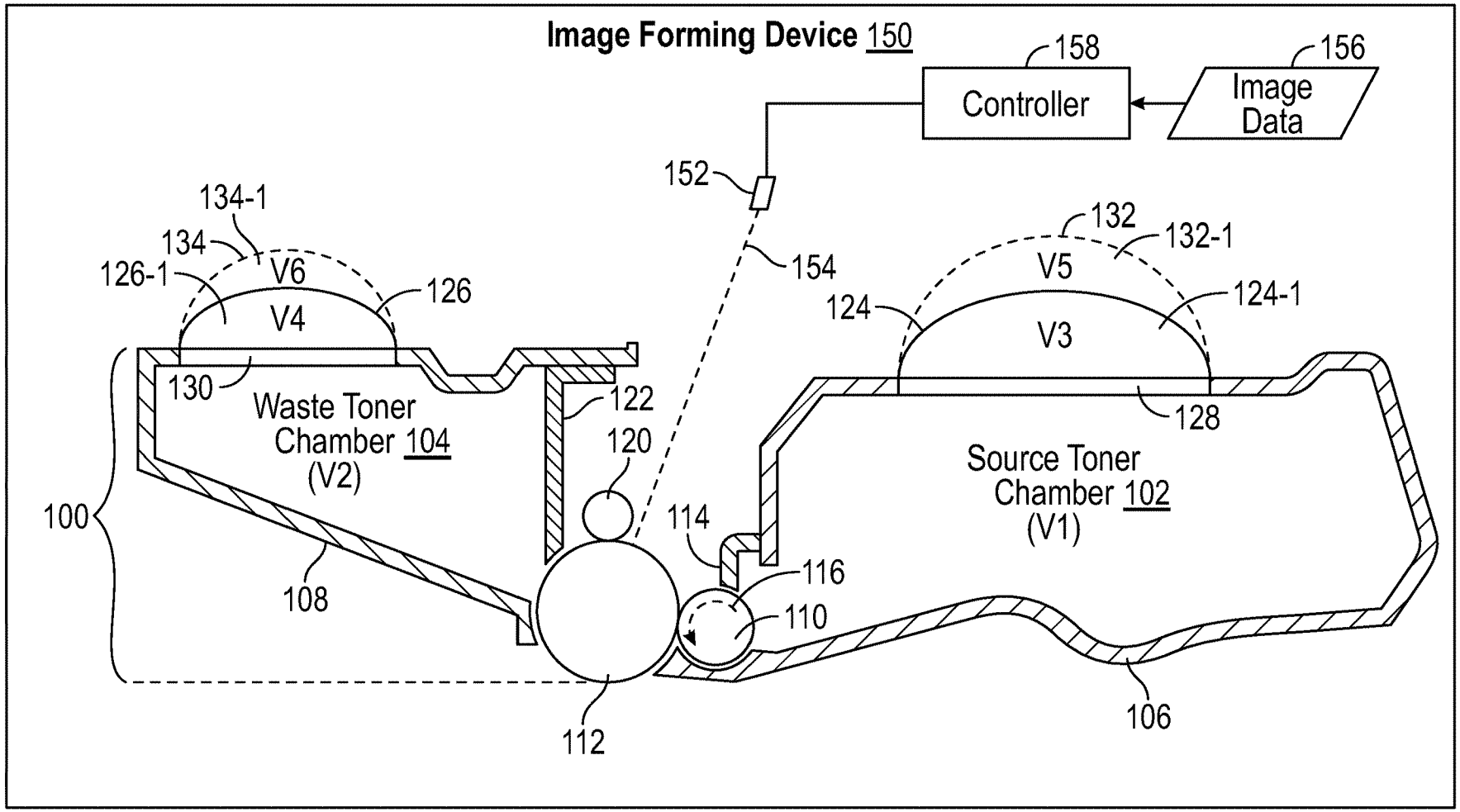
FIG. 1 is a sectional view of a toner cartridge according to some examples.

Throughout the drawings, identical reference numbers designate similar, but not necessarily identical, elements. The figures are not necessarily to scale, and the size of some parts may be exaggerated to more clearly illustrate the example shown. Moreover, the drawings provide examples and/or implementations consistent with the description; however, the description is not limited to the examples and/or implementations provided in the drawings.

DETAILED DESCRIPTION

In the present disclosure, use of the term "a," "an," or "the" is intended to include the plural forms as well, unless the context clearly indicates otherwise. Also, the term "includes," "including," "comprises," "comprising," "have," or "having" when used in this disclosure specifies the presence of the stated elements, but do not preclude the presence or addition of other elements.

An image forming device such as an electrophotographic printing device can employ a photoreceptor on which an electrostatic latent image is formed, for use in transferring an image to a target medium (e.g., a print medium such as a paper substrate or a substrate of another material). The photoreceptor can be in the form of a photosensitive drum that includes a cylindrical tubular structure and a photosensitive layer on the cylindrical tubular structure.

A charging element can be used to charge a surface of the photosensitive drum to a uniform electrical potential (e.g., a negative electrical potential). In some examples, the charging element can include a charging roller. In other examples, a charging element can be in the form of a corona charger that can charge the surface of the photosensitive drum to a uniform electrical potential without making physical contact with the surface of the photosensitive drum.

A light source (e.g., a laser source, light emitting diode(s) (LEDs), etc.) can be activated by a controller of the image forming device to irradiate selected portions of the charged surface of the photosensitive drum, to form an electrostatic latent image on the photosensitive drum.

A developing device in the image forming device includes a developer (e.g., a developing roller) onto which a developing agent including an electrically charged toner is adhered. During operation of the image forming device, as the developing roller rotates relative to the photosensitive drum (which rotates in the same or opposite rotational direction of the developing roller), the developing agent on the developing roller is conveyed to the photosensitive layer of the photosensitive drum on which the electrostatic latent image has been formed, which develops the electrostatic latent image on the surface of the photosensitive drum to form a visible toner image on the photosensitive drum.

In some examples, the developing device including the developing roller can be part of a cartridge that is removably inserted into the image forming device. The cartridge can include a volume containing a toner, and the toner in the volume can be transferred to the developing roller. Generally, a "cartridge" can refer to any container of a toner or another print material.

A cartridge manufacturer can make cartridges of different toner capacities that can accommodate different amounts of toner. The cartridges of different toner capacities can employ housings of different sizes. To make a larger housing for a cartridge of a larger toner capacity, a greater amount of housing material would be used.

Cartridges have environmental impacts. For example, using a greater amount of nonrenewable materials (e.g., plastics or other nonrenewable materials) to make cartridges can be associated with a greater environmental cost, both in terms of waste byproducts as well has increased energies associated with making the cartridges. Moreover, reuse of cartridges can be challenging, which further adds to their environment cost.

In accordance with some implementations of the present disclosure, a common housing structure can be used to make cartridges of different toner capacities. A housing of the common housing structure can include an inner housing volume of a base toner capacity to store a toner. Different cartridges of different toner capacities can use the same common housing structure that has the base toner capacity.

To adjust toner capacities of cartridges made with housings having the common housing structure, expansion bubbles of different sizes can be attached to the housings. An expansion bubble (also referred to as an "expansion toner module") is removably attached to the housing so that an inner module volume defined by the toner module together with the inner housing volume of the housing of a cartridge define an overall volume containing the toner for the cartridge. A cartridge with an expansion toner module attached has a toner capacity that is an aggregate of the base toner capacity (of the housing according to the common housing structure) and an expansion toner capacity of the expansion toner module.

Note that the expansion toner module is relatively rigid, and defines an inner module space that remains relatively fixed (and do not expand or contract with decreases or increases in an amount of toner within the respective inner module space of the expansion toner module during an image forming operation).

In some examples, the body of an expansion toner module can be formed of any or some combination of the following materials: a polymer (e.g., a thermoplastic polymer such as polyethylene, polypropylene, etc.), a plastic material (e.g., recycled plastics), and so forth. The thickness of the material used to form the body can be set to provide relative rigidity.

The housing is removably attachable to any of different toner modules that provide different inner module spaces with respective different expansion toner capacities. To form a cartridge with a larger toner capacity, a toner module defining a larger inner module space can be selected to attach to the cartridge housing. On the other hand, to form a cartridge with a smaller toner capacity, a toner module defining a smaller inner module space can be selected to attach to the cartridge.

FIG. 1 is a sectional view of a toner cartridge 100 (or more simply, "cartridge 100"). Although reference is made to cartridges for containing toners in some examples, it is noted that techniques or mechanisms according to some implementations of the present disclosure can be used with cartridges for other types of print materials, including a printing fluid used in a three-dimensional (3D) printing system (also referred to as an additive manufacturing machine), and so forth. Although FIG. 1 shows an example of the cartridge 100, in other examples, cartridges can have other forms and components.

The cartridge 100 can include a housing formed with multiple housing sections, including a first housing section 106 and a second housing section 108. Each housing section acts as the load bearing structural part of the cartridge 100 allowing thin materials that control volume to be modular and non-structural to the mechanical design of the cartridge 100. The housing sections 106 and 108 can be integrally formed with one another, or alternatively, the housing sections 106 and 108 can be separate from one another but are attached together.

The cartridge 100 can have multiple inner toner chambers, including a source toner chamber 102 that contains a source toner to be provided for an image forming operation, and a waste toner chamber 104 to receive a waste toner.

The cartridge 100 can be installed in an image forming device 150, such as a two-dimensional (2D) printing system, a 3D printing system, and so forth. In some examples, the cartridge 100 is removably installed in the image forming device 150. For example, the image forming device 150 may be shipped without a cartridge, and the cartridge 100 can be installed by a user for use. When the cartridge 100 is depleted of toner, the user can remove the cartridge 100 from the image forming device 150, and can install a new cartridge 100 in the image forming device 150.

In some examples, the cartridge 100 includes a developer roller 110 and a photoreceptor in the form of a photosensitive the drum 112. The developing roller 110 and the photosensitive drum 112 are rotatably mounted to the housing of the cartridge 100.

The toner in the source toner chamber 102 is transferred to the developing roller 110, which in turn transfers the toner to the photosensitive drum 112. The cartridge 100 can include a regulating blade 114 or another type of regulator that regulates a thickness of the toner that is adhered to the outer surface of the developing roller 110. The regulating blade 114 can be omitted in other examples. A tip of the regulating blade 114 can come into contact or be close proximity with the outer surface of the developing roller 110. As the developing roller 110 rotates in a first rotational direction 116, the electrically charged toner is transferred from the source toner chamber 102 to the outer surface of the developing roller 110 (the electrically charged toner is attracted to the outer surface of the developing roller 110 by a bias voltage applied to the developing roller 110). The regulating blade 114 sets the thickness of the toner on the developing roller 110 to be uniform as the developing roller 110 rotates.

The bias voltage applied to the developing roller 110 is from a voltage source (not shown) of the image forming device 150.

In some examples, an outer surface of the developing roller 110 can make physical contact with the outer surface of the photosensitive drum 112. In other examples, the outer surface of the developing roller 110 is in sufficiently close proximity to the outer surface of the photosensitive drum 112 such that the toner that is on the outer surface of the developing roller 110 can be transferred to the outer surface of the photosensitive drum 112 (or more specifically, to the outer surface of a photosensitive layer of the photosensitive drum 112).

The cartridge 100 can also include an imaging charging element in the form of a charging roller 120. In other examples, the imaging charging element can be in the form of a corona charger.

The image forming device 150 in which the cartridge 100 is provided can include a light source 154 to irradiate selected portions of the electrically charged outer surface of the photosensitive drum 112 with light. The light emitted from the light source is modulated according to image data 156 received by a controller 158 of the image forming device 150.

Note that the light source 152 can be external of the cartridge 100 and can be part of the image forming device 150.

The transfer of the toner to the photosensitive drum 112 develops the electrostatic latent image on the surface of the photosensitive drum 112 to form a visible toner image on the photosensitive drum 112.

The toner image on the photosensitive drum 112 can then be transferred either directly to a print medium (e.g., paper, plastic foil, cloth layer, etc.) or can be transferred to a transfer roller or belt which then transfers the toner image to a print medium.

Any toner remaining on the photosensitive drum 112 after a portion of the toner image has been transferred to a print medium or a transfer roller is considered to be a "waste toner." The waste toner is transferred to the waste toner chamber 104. A shuttle member 122 can direct the waste toner into the waste toner chamber 104.

The source toner chamber 102 has a first volume V1, and the waste toner chamber 104 has a second volume V2. In accordance with some implementations of the present disclosure, expansion bubbles in the form of expansion toner modules 124 and 126 are removably attached to the housing sections 106 and 108, respectively.

The expansion toner module 124 has an inner module space 124-1, and the expansion toner module 126 has an inner module space 126-1. The volume of the inner module space 124-1 is V3, and the volume of the inner module space 126-1 is V4.

An opening 128 is formed in an upper segment of the housing section 106. The opening 128 allows for communication of toner between the inner module space 124-1 and the source toner chamber 102. An aggregate toner storage space provided by the combination of the source toner chamber 102 and the inner module space 124-1 of the expansion toner module 124 is V1+V3.

Similarly, an opening 130 is formed in an upper segment of the housing section 108, to allow for communication of toner between the inner module space 126-1 of the expansion toner module 126 and the waste toner chamber 104. An aggregate toner storage space for the waste toner provided by the combination of the waste toner chamber 104 and the inner module space 126-1 of the expansion toner module 126 is V2+V4.

Although FIG. 1 shows the openings 128 and 130 formed in the respective upper segments of the housing sections 106 and 108, in other examples, the openings 128 and 130 can be formed on different sides of the housing sections 106 and 108.

In accordance with some examples, the cartridge housing can be attached to toner modules with different inner module spaces. For example, an expansion toner module 132 having a larger inner module space 132-1 (with volume V5) than the expansion toner module 124 can be removably attached to the housing section 106, and similarly, an expansion toner module 134 having an inner module space 134-1 (with volume V6) that is larger than the inner module space 126-1 of the expansion toner module 126 can be removably attached to the housing section 108. Removable attachment of an expansion toner module refers to an attachment that can be reversed without destruction or damage of the cartridge housing. For example, the expansion toner module is not welded or glued or otherwise affixed to the cartridge housing such that removal of the expansion toner module from the cartridge housing would damage the cartridge housing. Use of the expansion toner modules 132 and 134 increases the overall toner capacity of the cartridge 100 as compared with use of the expansion toner modules 124 and 126.

In further examples, a flat cover can be removable attached to cover the opening 128 or 130 of the housing section 106 or 108, respectively. The flat cover would not add to the volume of the source toner chamber 102 or waste toner chamber 104, respectively.

Although FIG. 1 shows examples where expansion toner modules can be added to both the source toner chamber 102 and the waste toner chamber 104 to increase their respective toner storage capacities, in other examples, an expansion toner module can be added to just the source toner chamber 102 or the waste toner chamber 104, but not the other.

Figure 2A:
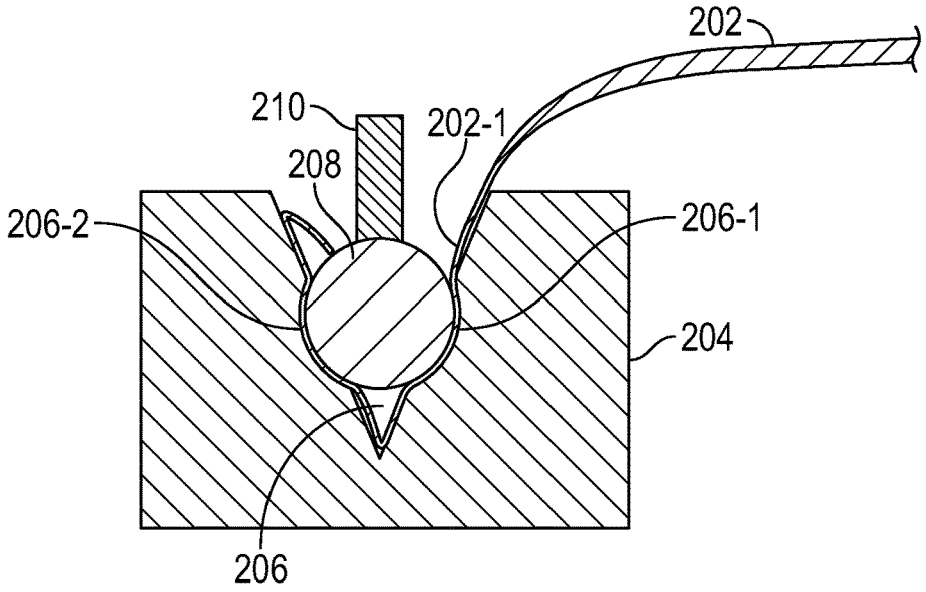
FIGS. 2A-2C show attachment mechanisms to attach expansion toner modules to cartridges according to some examples.
Figure 2B:
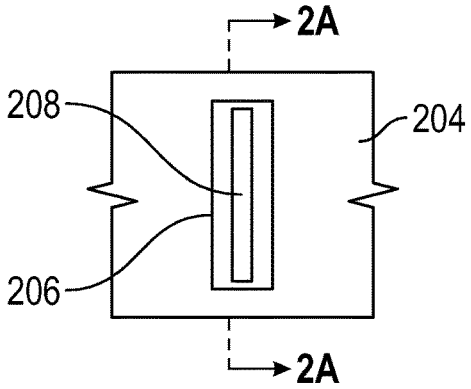

FIGS. 2A and 2B show examples of two variants of attachment mechanisms to affix a toner module body 202 of an expansion toner module (any of 124, 126, 132, or 134 shown in FIG. 1) to a cartridge housing 204. To allow for attachment of the toner module body 202 to the cartridge housing 204, an edge portion 202-1 of the toner module body 202 is pliable but has a memory characteristic that allows the edge portion 202-1 to revert back to its initial shape. For example, the edge portion 202-1 of the toner module body 202 can be formed of a thinner material (than the rest of the toner module body 202) such that the edge portion 202-1 can be easily bent or otherwise warped.

In the ensuing discussion, the edge portion 202-1 of the toner module body 202 that is removably attach to the cartridge housing 204 is referred to as a "toner module engagement portion."

In FIG. 2A, the toner module engagement portion 202-1 of the toner module body 202 is inserted into an attachment groove 206 formed in a surface of the cartridge housing 204 around an opening (e.g., 128 or 130 in FIG. 1). The attachment groove 206 has a cross-sectional profile (e.g., along section 2A-2A in FIG. 2B) that is generally V-shaped.

The attachment groove 206 includes indentations 206-1 and 206-2 on the two sidewalls of the attachment groove 206. A locking band 208 is inserted into the attachment groove 206, and engages the outer surface of the toner module engagement portion 202-1. The locking band 208 when inserted into the attachment groove 206 pushes portions of the toner module engagement portion 202-1 into the indentations 206-1 and 206-2. The engagement of the locking band at 208 in the indentations 206-1 and 206-2 (with the toner module engagement portion 202-1 between the locking band 208 and the walls of the attachment groove 206) causes the locking band 208 to be lockingly engaged in the indentations 206-1 and 206-2, and can provide a robust mechanical seal that holds the toner expansion module in place as well as prevent toner or other print material leakage.

A pull tab 210 is attached to the locking band 208. The pull tab 210 allows a user to pull the locking band 208 out of the indentations 206-1 and 206-2, and out the attachment groove 206, to disengage the toner module body 202 from the cartridge housing 204.

FIG. 2B is a top view of the attachment groove 206 and the locking band 208. The toner module body 202 is omitted in FIG. 2B to allow the attachment groove 206 to be visible. Each of the attachment groove 206 and the locking band 208 has an elongated shape that extends across a width of the cartridge housing 204.

Figure 2C:
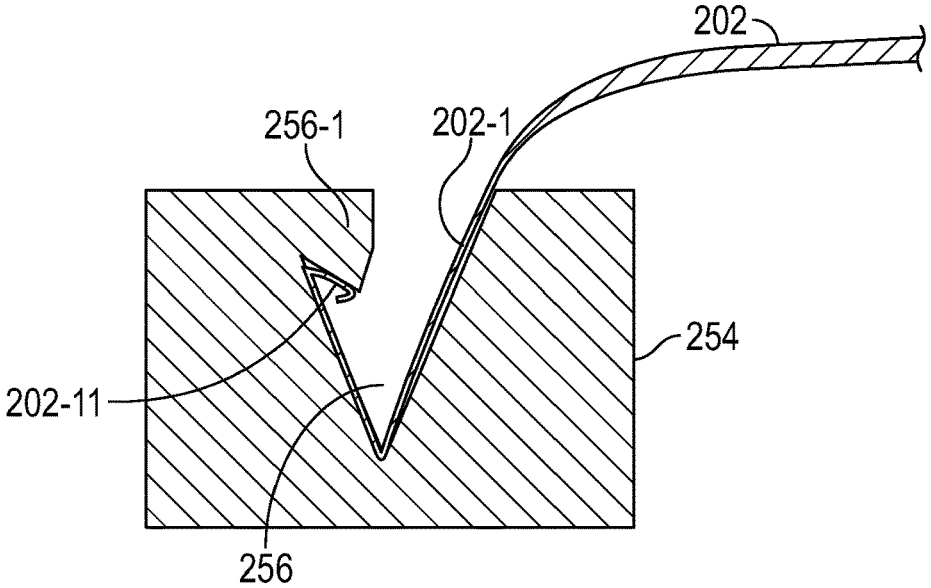

FIG. 2C shows a cartridge housing 254 with an attachment groove 256 that has a different profile from the attachment groove 206 of FIG. 2A. The attachment groove 256 of FIG. 2C has an overhang portion 256-1. The toner module engagement portion of the toner module body 202 is inserted into the attachment groove 256 to removably attach the toner module body 202 to the cartridge housing 254. An end segment 202-11 of the toner module engagement portion 202-1 fits under the overhang portion 256-1 of the attachment groove 256. The engagement between the end segment 202-11 and a lower surface of the overhang portion 256-1 locks the toner module engagement portion 202-1 of the toner module body 202 in the attachment groove 256. The toner module engagement portion 202-1 provides a mechanical connection between the toner module body 202 and the cartridge housing 204 and provides a sealing engagement by mechanically closing gaps and providing a tortuous flow path (to provide a labyrinth seal). To remove the toner module body 202 from the cartridge housing 254, a user can pull on the toner module body 202 to disengage the toner module engagement portion 202-1 from the attachment groove 256.

FIG. 2C shows a self-locking feature between the toner module body 202 and the cartridge housing 254, while FIG. 2A shows a locking feature that includes the locking band 208 and the pull tab 210.

Figure 3:
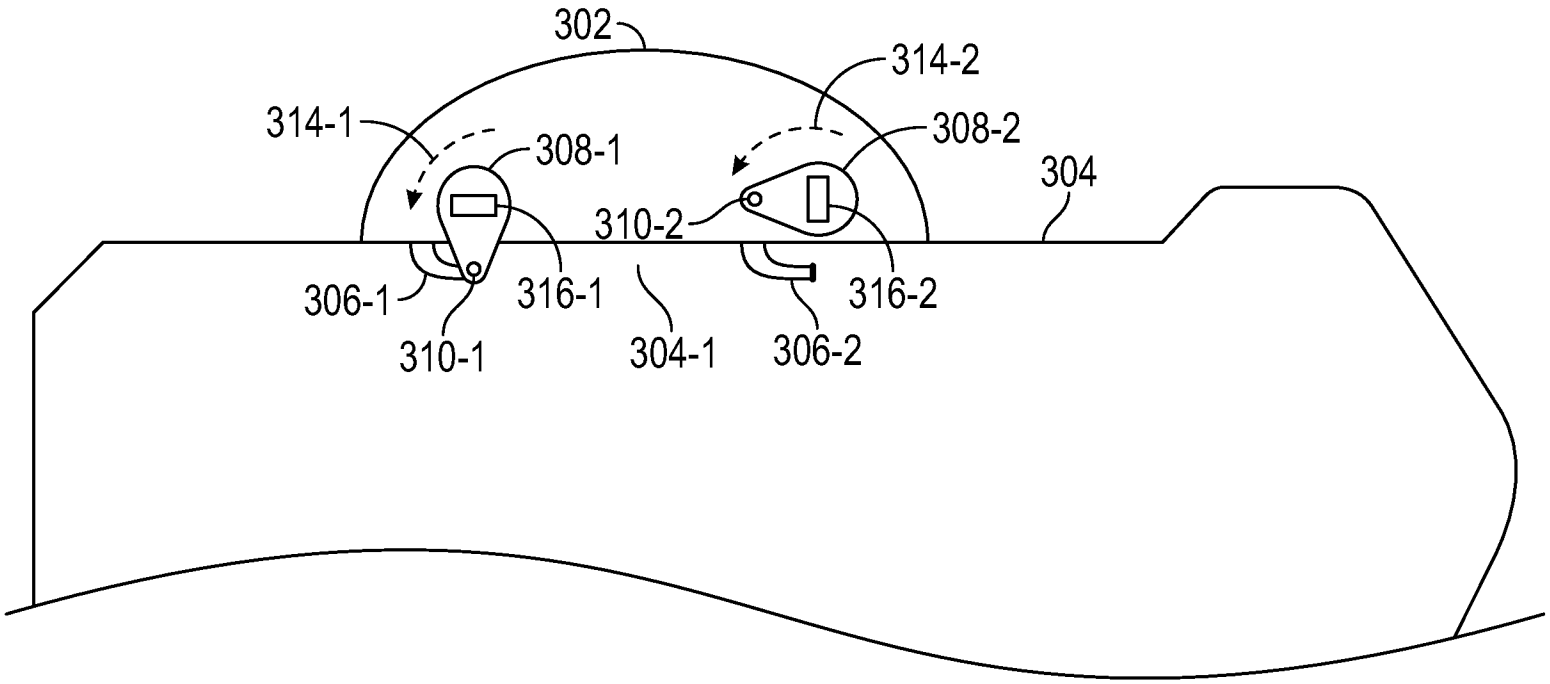
FIG. 3 shows another attachment mechanism to attach an expansion toner module to a toner cartridge, according to further examples.

FIG. 3 shows a different type of attachment mechanism to removably attach an expansion toner module 302 to a cartridge housing 304. In FIG. 3, locking grooves 306-1 and 306-2 can be formed in a side wall 304-1 of the cartridge housing 304. Cam locks 308-1 and 308-2 can be pivotally attached to the toner module 302. Each cam lock 308-1 or 308-2 can be rotated along a respective rotational direction 314-1 or 314-2 such that a respective pin 310-1 or 310-2 can engage the locking groove 306-1 or 306-2, respectively. Each locking groove 306-1 or 306-2 has a semi-arcuate shape.

In FIG. 3, the cam lock 308-1 is in a locked position in which the cam lock 308-1 has been rotated from an unlocked position in the rotational direction 314-1 so that the pin 310-1 of the cam lock 308-1 has traveled along an arcuate path of the locking groove 306-1 to the locked position.

In FIG. 3, the cam lock 308-2 is in an unlocked position prior to the rotation of the cam lock 308-2 along the rotational direction 314-2. Multiple cam locks can provide a uniform clamping force to the perimeter of the expansion toner module 302 to facilitate the sealing action and prevents toner leakage. The quantity of cam locks can be determined by a target clamping force to attach the expansion toner module 302 to the cartridge housing 304.

Each cam lock 308-1 or 308-2 includes an engagement slot 316-1 or 316-2, respectively, that is engageable by a tool or a user's finger to rotate the respective cam lock 308-1 or 308-2 between the unlocked position and the locked position. The cam locks 308-1 and 308-2 pull the cartridge housing 304 and the expansion toner module 302 together to complete a mechanical toner tight seal between the two parts. In some examples, an elastic seal and/or a labyrinth seal can be provided at the interface of the cartridge housing 304 and the expansion toner module 302 to provide sealing.

Figure 4A:
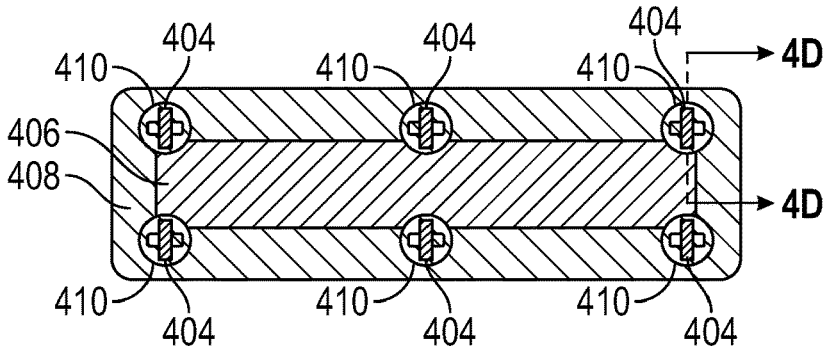
FIGS. 4A-4E show an attachment mechanism to attach an expansion toner model to a toner cartridge, according to yet further examples.
Figure 4B:
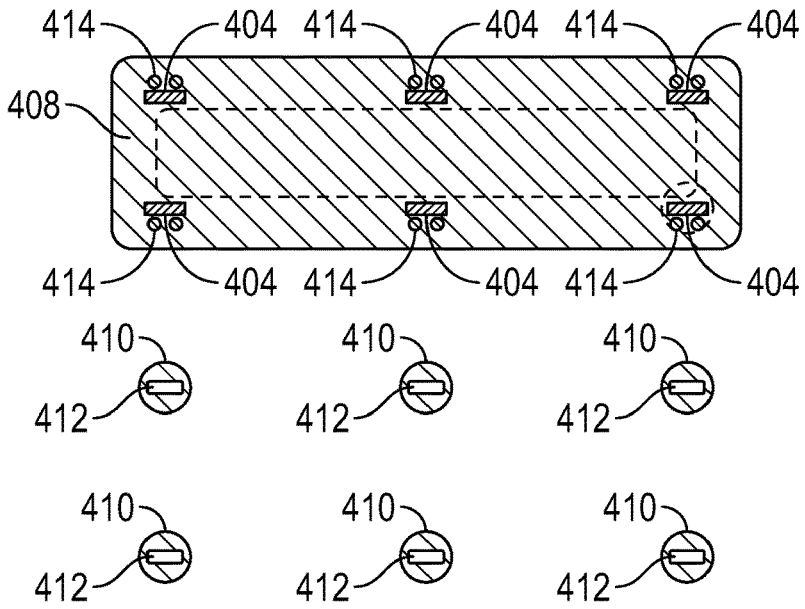

FIGS. 4A-4E show an attachment mechanism according to further examples. As shown in each of FIGS. 4A and 4B, six (or a different quantity of) swivel locks 404 are provided for locking a toner module body 406 (of an expansion toner module) to a cartridge housing 408. The quantity of swivel locks 404 can be determined by a target clamping force to attach the toner module body 406 to the cartridge housing 408. FIG. 4B shows an example where the toner module body 406 has been removed from the cartridge housing 408, and FIG. 4A shows an example where the toner module body 406 is attached to the cartridge housing 408.

Force clips 410 can be engaged to the respective swivel locks 404. Each force clip 410 is generally circular in shape and has a generally rectangular opening 412 through which the swivel lock 404 can pass when the force clip 410 is placed over the respective swivel lock 404. Each swivel lock 404 is also generally rectangular in shape and can fit through the opening 412 of a respective force clip 410.

In other examples, the swivel locks 404, force clips 410, and openings 412 in the force clips 410 can have other shapes.

Figure 4C:
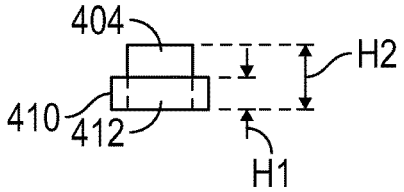

A cross-sectional view of a swivel lock 404 and a force clip 410 through which the swivel lock 404 has passed is shown in FIG. 4C. The force clip 410 has a first height H1, and the swivel lock 404 has a second height H2 that is greater than H1. In this way, the swivel lock 404 can pass through the opening 412 of the force clip 410 and can have a portion that extends above the force clip 410.

As further shown in FIG. 4B, alignment features 414 are provided adjacent respective swivel locks 404 on the cartridge housing 408. The force clips 410 can be engaged to the alignment features 414 to align the force clips 410 for engagement with the respective swivel locks 404.

The force clips 410 can be placed over the swivel locks 404 after the toner module body 406 has been placed on the cartridge housing 408, as shown in FIG. 4A. The force clips 410 are to attach to respective engagement portions of the toner module body 406. Once the force clips 410 are placed over the swivel locks 404 such that the swivel locks 404 pass through the openings 412 of the force clips 410, a user can twist the swivel locks 404 (either with the user's fingers or a tool) by about 90° to the respective locked positions shown in FIG. 4A. In the locked positions of the swivel locks 404, the toner module body 406 is attached to and sealed to the cartridge housing 408.

Figure 4D:
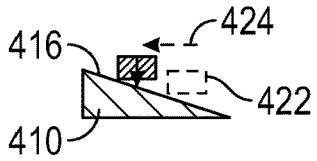

In some examples, a force clip 410 can have a sloped engagement surface 416, as shown in FIG. 4D. FIG. 4D is a cross-section view taken along section 4D-4D in FIG. 4A. The swivel lock 404 engages the sloped engagement surface 416, such that when the swivel lock 404 is twisted from an initial unlocked position (as shown in FIG. 4B and represented by a dashed profile 422) to a locked position (as shown in FIG. 4A), the swivel lock 404 rides up the sloped engagement surface 416 along a direction 424. The swivel lock 404 riding up the sloped engagement surface 416 applies a downward force onto the force clip 410 such that the force clip 410 presses the toner module body 406 downwardly against the cartridge housing 408. The combination of the force clip 410 and the swivel lock 404 provides a spring-loaded lock.

Figure 4E:
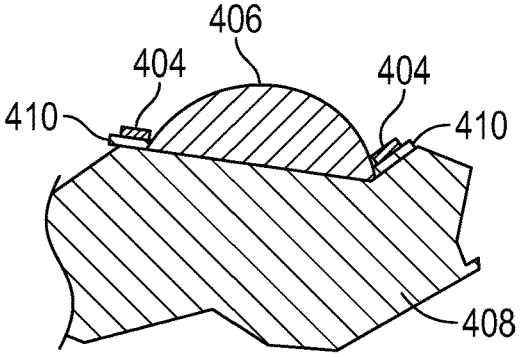

FIG. 4E is a side view of the toner module body 406 affixed to the cartridge housing 408 by the swivel locks 404 and force clips 410. In some examples, an elastic seal and/or a labyrinth seal can be provided at the interface of the cartridge housing 408 and the toner module body 406 to provide sealing.

FIGS. 5A-5G show another example attachment mechanism to attach a toner module body 504 (of an expansion toner module) to a cartridge housing 506, according to further implementations of the present disclosure. The attachment mechanism of FIGS. 5A-5G include rotatable spring clips 502 to attach the toner module body 504 to the cartridge housing 506. The spring clip 502 is another example of a spring-loaded lock. The quantity of spring clips 502 can be determined by a target clamping force to attach the toner module body 504 to the cartridge housing 506.

Figure 5A:
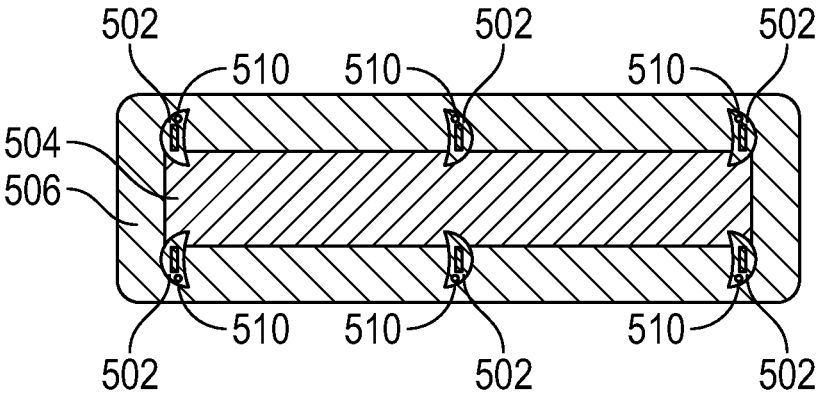
FIGS. 5A-5G show an attachment mechanism to attach an expansion toner module to a toner cartridge, according to other examples.
Figure 5B:
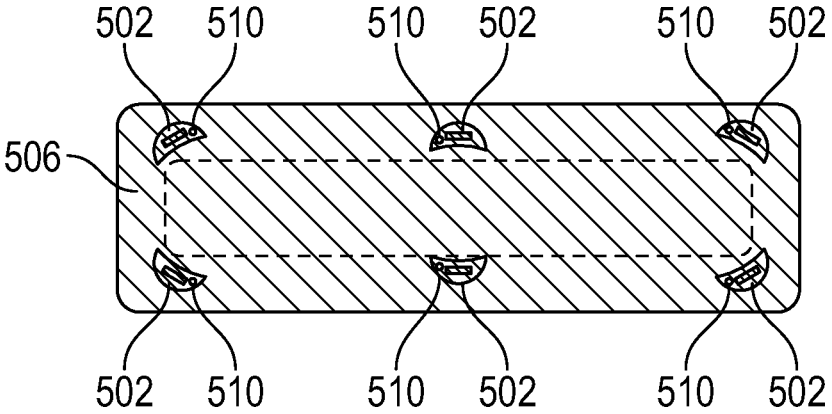
Figure 5C:
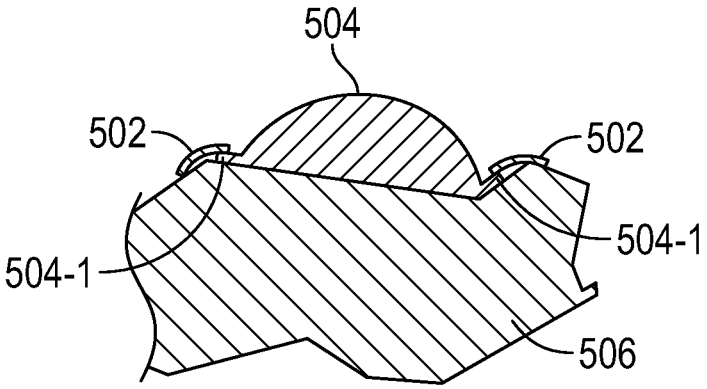

FIG. 5A shows that the toner module body 504 has been placed on the cartridge housing 506, and the rotatable spring clips 502 have been rotated to their locked position to affix the toner module body 504 to the cartridge housing 506. FIG. 5B shows the rotatable spring clips 502 in an unlocked position, where the toner module body 504 has been removed from the cartridge housing 506. FIG. 5C is a side view of the toner module body 504 affixed to the cartridge housing 506 by the spring clips 502. The spring clips 502 apply a downward force on an engagement portion 504-1 of the toner module body 504 to seal the toner module body 504 against the cartridge housing 506.

As shown in FIGS. 5A and 5B, each spring clip 502 is pivotally attached to the cartridge housing 506 at a respective pivot point 510. In some examples, an elastic seal and/or a labyrinth seal can be provided at the interface of the cartridge housing 506 and the toner module body 504 to provide sealing.

Figure 5F:
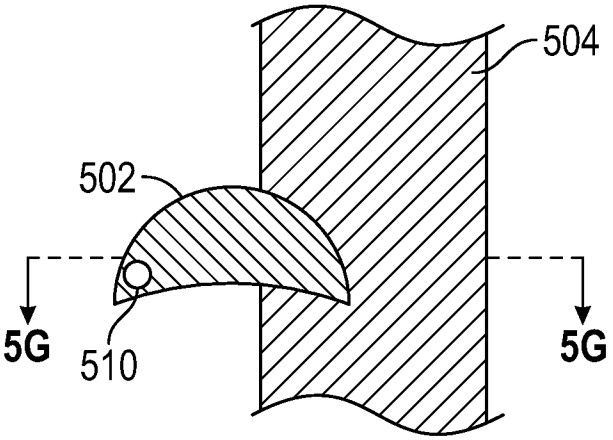
Figure 5G:
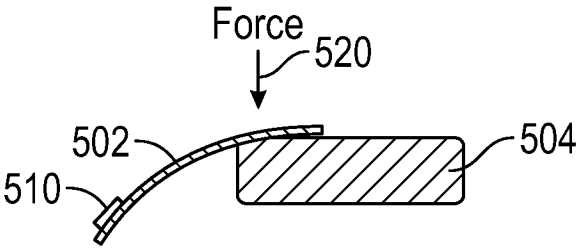
Figure 5D:
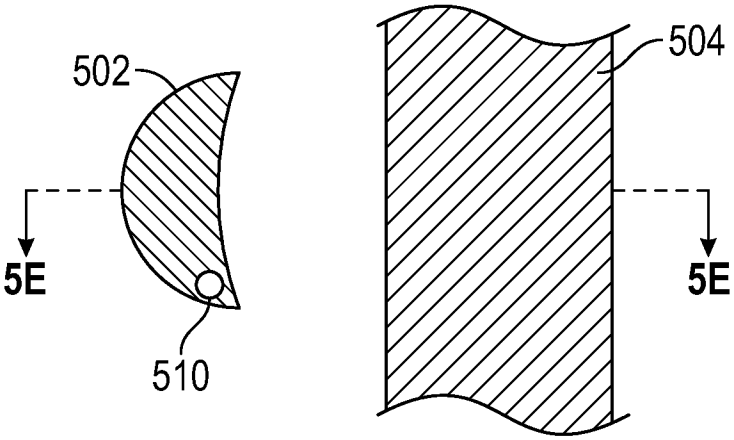
Figure 5E:
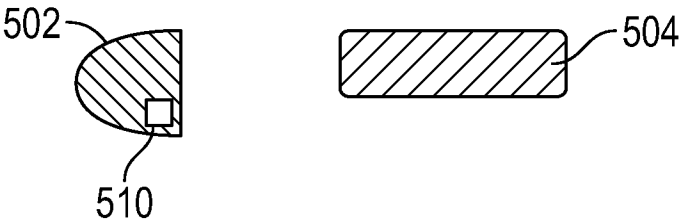

FIG. 5D is a top view of a spring clip 502 and a portion of the toner module body 504. In FIG. 5D, the spring clip 502 is in the unlocked position. A cross-sectional view of the spring clip 502 and the toner module body 504 along section 5E-5E is shown in FIG. 5E.

In FIG. 5F is a top view of the spring clip 502 in the locked position, after pivoting of the spring clip 502 from the unlocked position of FIG. 5D to the locked position of FIG. 5F with respect to the pivot point 510. A cross-sectional view of the spring clip 502 and the toner module body 504 along section 5G-5G is shown in FIG. 5G. As seen in FIG. 5G, the spring clip 502 has a curved shape. After engagement of the spring clip 502 with the toner module body 504, the spring clip 502 wants to maintain its curved shape, and this curvature causes the spring clip 502 to apply a downward force (520) on the toner module body 504.

Figure 6:
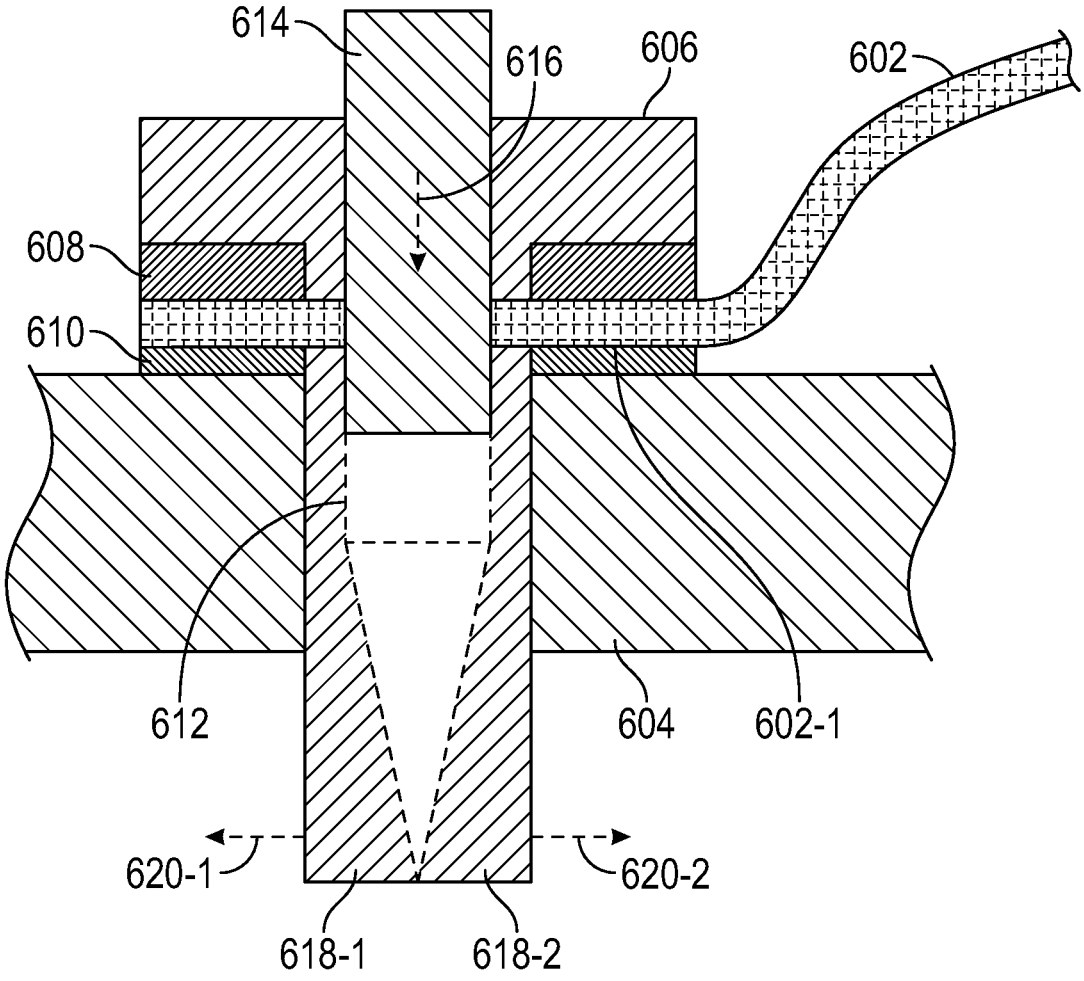
FIG. 6 shows an attachment mechanism to attach an expansion toner module to a toner cartridge, according to additional examples.

FIG. 6 shows a different example of an attachment mechanism to attach toner module body 602 (of an expansion toner module) to a cartridge housing 604. A fastener 606 can penetrate through a toner module engagement portion 602-1 of the toner module body 602. Gaskets 608 and 610 can be provided on both sides of the toner module engagement portion 602-1 to provide a seal when the fastener 606 penetrates through the toner module engagement portion 602-1. Alternatively or additionally, labyrinth seals can be used instead of or in addition to the gaskets 608 and 610. The fastener 606 can be in the form of a screw, a bolt, a rivet, or any other type of fastener.

The fastener 606 is a reversible rivet fastener so that the fastener 606 can be disengaged without plastic deformation from the cartridge housing 604 after fastening to the cartridge housing 604. For example, if the fastener 606 is a screw, a screwdriver can be used to screw the fastener 606 into the cartridge housing 604. The fastener 606 can be unscrewed using the screwdriver.

In further examples, the fastener 606 has an inner longitudinal slot 612 through which a member 614 can be inserted along the slot 612 in a direction 616. Pushing the member 614 into the slot 612 causes end portions 618-1 and 618-2 of the fastener 606 to elastically expand outwardly in directions 620-1 and 620-2, respectively. The outward expansion of the end portions 618-1 and 618-2 tightens the engagement between the fastener 606 and the cartridge housing 604.

The member 614 can be removed to release the fastener 606 from the cartridge housing 604 so that the toner module body 602 can be removed from the cartridge housing 604.

Figure 7:
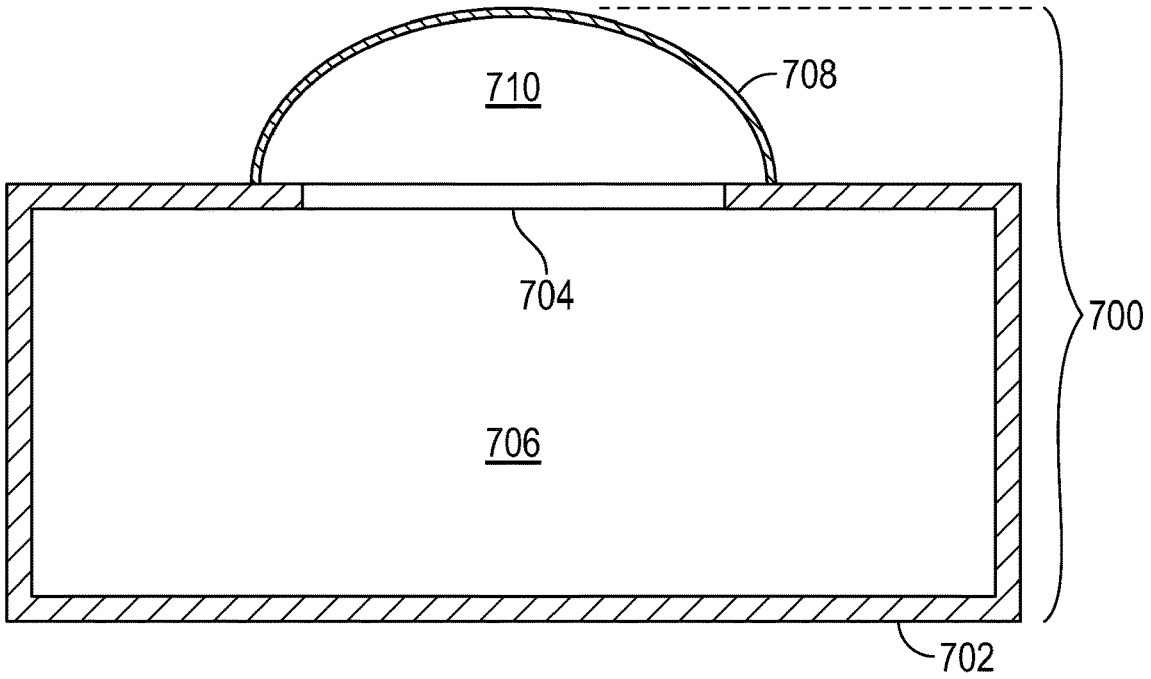
FIG. 7 is a schematic diagram of a print material apparatus according to some examples.

FIG. 7 is a block diagram of a print material apparatus 700. An example of the print material apparatus 700 is a toner cartridge as discussed above.

The print material apparatus 700 includes a housing 702 (e.g., any of the cartridge housing 204, 254, 304, 408, 506, or 604) having an opening 704 and an inner housing space 706.

The print material apparatus 700 includes a module 708 (e.g., any of module 202, 302, 406, 504, or 602) removably attached to the housing 702 to cover the opening 704. The module 708 provides an inner module space 710 that together with the inner housing space 706 define a volume containing a print material of the print material apparatus 700.

The housing 702 is attachable to different modules that provide respective inner module spaces of different sizes for defining different print material containment capacities of the print material apparatus 700.

In some examples, an edge portion of the module 708 is pliable to removably engage with an attachment feature (e.g., an attachment groove 206 or 256 in FIG. 2A or 2C, respectively) of the housing 702.

In some examples, the module 708 is removably attached to the housing 702 without any adhesive.

In some examples, the housing 702 includes a groove (e.g., 206 or 256 in FIG. 2A or 2C, respectively) around the opening 704, where the module 708 is attached to the housing 702 in the groove.

In some examples, a locking member (e.g., the locking band 208 of FIG. 2A) is inserted into the groove and engaged with an edge portion of the module 708 to lock the module 708 to the housing 702.

In some examples, a release member (e.g., a pull tab 210 in FIG. 2A) is attached to the locking member, and the release member when pulled disengages the locking member from the groove.

Figure 8:
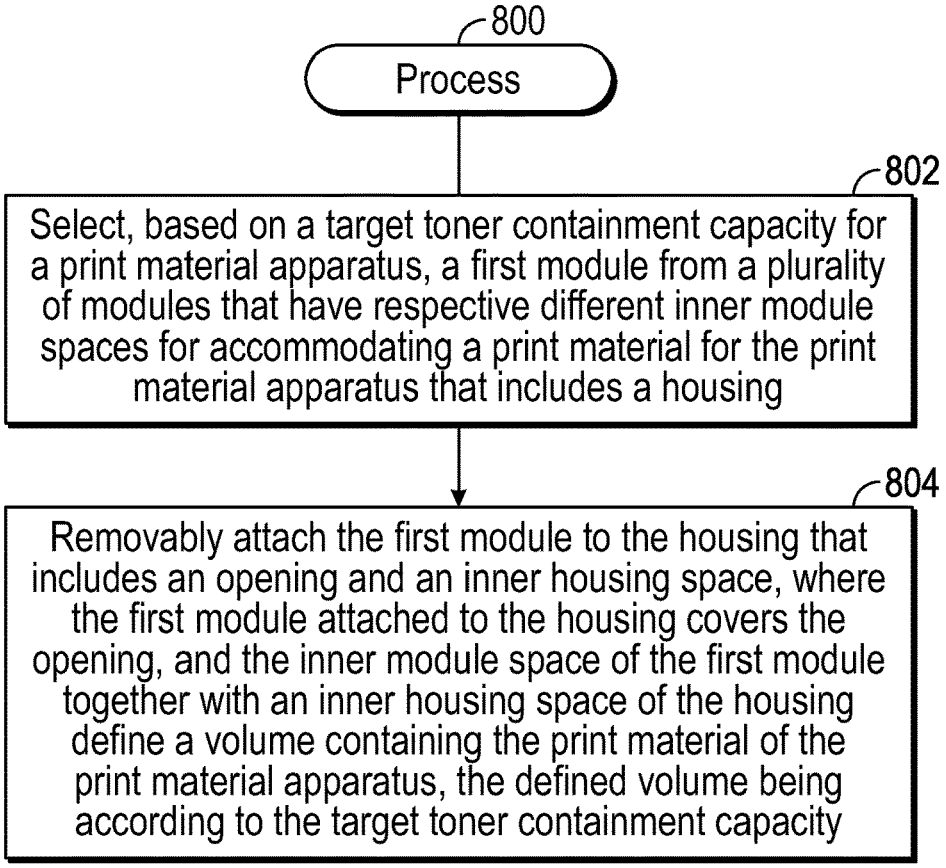
FIG. 8 is a flow diagram of a process according to some examples.

FIG. 8 is a flow diagram of a process 800 according to some examples. The process 800 includes selecting (at 802), based on a target toner containment capacity for a print material apparatus, a first module from a plurality of modules that have respective different inner module spaces for accommodating a print material for the print material apparatus that includes a housing. The housing is attachable to any of the plurality of modules that define different print material containment capacities of the print material apparatus.

The process 800 includes removably attaching (at 804) the module to the housing that includes an opening and an inner housing space, where the first module attached to the housing covers the opening, and the inner module space of the first module together with an inner housing space of the housing define a volume containing the print material of the print material apparatus, the defined volume being according to the target toner containment capacity. In some examples, the housing (e.g., a cartridge housing) has a design based on any of various models, where the models can depend upon capacities for a print material.

By using different expansion toner modules to provide different toner containment capacities, a common housing structure of a cartridge (or any other type of a print material apparatus) can be used (and possibly reused). In some examples, films or sheet materials formed using thermoforming techniques can be applied to form the housing of the print material apparatus, so that a minimum wall thickness for an injection molding process would not have to be used. Reducing the wall thickness of the housing can result in less materials being used in cartridges.

Reusing a cartridge reduces an environmental impact of the cartridge. Also, in some cases, the expansion toner modules can be formed using renewable materials (such as recycled plastics), which further improves environmental sustainability.

In the foregoing description, numerous details are set forth to provide an understanding of the subject disclosed herein. However, implementations may be practiced without some of these details. Other implementations may include modifications and variations from the details discussed above. It is intended that the appended claims cover such modifications and variations.

What is claimed is:

1. A print material apparatus comprising:

a housing comprising a first opening and an inner housing space;

a module removably attached to the housing to cover the first opening, the module providing an inner module space that together with the inner housing space define a volume containing a print material of the print material apparatus, wherein the housing is attachable to different modules that provide respective inner module spaces of different sizes for defining different print material containment capacities of the print material apparatus; and a fastener to attach the module to the housing, the fastener to extend into a second opening in the housing.

2. The print material apparatus of claim 1, wherein an edge portion of the module is pliable to removably engage with an attachment feature of the housing.

3. The print material apparatus of claim 1, wherein the print material comprises a toner, and the print material apparatus comprises a toner cartridge that includes:

an assembly comprising a developer and a photoconductor, wherein the housing is a first housing and the module is a first module, and wherein the volume provided by the inner module space and the inner housing space is a source volume to supply the toner to the developer;

a second housing comprising a second opening and an inner second housing space; and a second module attached to the second housing to cover the second opening, the second module providing a second inner module space that together with the inner second housing space define a waste toner volume to receive a waste toner from the assembly.

4. The print material apparatus of claim 1, wherein the module is attached to the housing without any adhesive.

5. The print material apparatus of claim 1, wherein the housing comprises a groove around the opening, and wherein the module is attached to the housing in the groove.

6. The print material apparatus of claim 5, further comprising:

a locking member inserted into the groove and engaged with an edge portion of the module to lock the module to the housing.

7. The print material apparatus of claim 6, wherein the groove has sidewalls including indentations, and wherein the locking member is engaged in the indentations.

8. The print material apparatus of claim 6, further comprising a release member attached to the locking member, the release member when pulled disengages the locking member from the groove.

9. The print material apparatus of claim 5, wherein the groove has an overhang to prevent the module from disengaging from the groove.

10. The print material apparatus of claim 1, further comprising moveable locks that are actuatable between a first position and a second position, wherein in the first position the module is disengageable from the housing, and wherein in the second position the module is lockingly attached to the housing.

11. The print material apparatus of claim 10, wherein the moveable locks are spring-loaded locks.

12. A print material apparatus comprising:

a housing comprising an opening, an inner housing space, and a groove around the opening;

a module removably attached to the housing in the groove to cover the opening, the module providing an inner module space that together with the inner housing space define a volume containing a print material of the print material apparatus, wherein the housing is attachable to different modules that provide respective inner module spaces of different sizes for defining different print material containment capacities of the print material apparatus, wherein the groove has an overhang to prevent the module from disengaging from the groove.

13. The print material apparatus of claim 12, further comprising a fastener to attach the module to the housing, the fastener to extend into an opening in the housing.

14. The print material apparatus of claim 12, wherein the module is attached to the housing without any adhesive.

15. The print material apparatus of claim 12, wherein an edge portion of the module is pliable to removably engage with an attachment feature of the housing.

16. A method comprising:

selecting, based on a target print material containment capacity for a print material apparatus, a first module from a plurality of modules that have respective different inner module spaces for accommodating a print material for the print material apparatus that includes a housing, wherein the housing is attachable to any of the plurality of modules that define different print material containment capacities of the print material apparatus; and removably attaching the first module to the housing comprising an opening and an inner housing space, wherein the first module attached to the housing covers the opening, and an inner module space of the first module together with the inner housing space of the housing define a volume containing the print material of the print material apparatus, the defined volume being according to the target print material containment capacity, and wherein the housing comprises a groove around the opening, the first module is attached to the housing in the groove, a locking member is inserted into the groove and engaged with an edge portion of the first module to lock the first module to the housing, and a release member is attached to the locking member, the release member when pulled disengages the locking member from the groove.

17. The method of claim 16, further comprising:

after a depletion of the print material in the print material apparatus, removing the first module from the housing; and attaching a further module to the housing and adding a further print material to a volume defined by the inner housing space and an inner module space of the further module.

18. A toner cartridge comprising:

an assembly comprising a developer and a photoconductor;

a first housing comprising a first opening and a first inner housing space;

a first module removably attached to the first housing to cover the first opening, the first module providing a first inner module space that together with the first inner housing space define a volume containing a toner of the toner cartridge, wherein the volume is a source volume to supply the toner to the developer, and wherein the first housing is attachable to different modules that provide respective inner module spaces of different sizes for defining different toner containment capacities of the toner cartridge;

a second housing comprising a second opening and a second inner housing space; and a second module attached to the second housing to cover the second opening, the second module providing a second inner module space that together with the second inner housing space define a waste toner volume to receive a waste toner from the assembly.

19. The toner cartridge of claim 18, wherein the first housing comprises a groove around the first opening, and wherein the first module is attached to the first housing in the groove.

20. The toner cartridge of claim 19, wherein the groove has an overhang to prevent the first module from disengaging from the groove.

* * * * *